US007607327B2

(12) United States Patent
Sumida et al.

(10) Patent No.: US 7,607,327 B2
(45) Date of Patent: Oct. 27, 2009

(54) DRUM TYPE WASHING MACHINE

(75) Inventors: Katsuaki Sumida, Osaka (JP); Kenji Terai, Osaka (JP); Koichi Kubo, Hyogo (JP)

(73) Assignee: Panasonic Corporation, Osaka (JP)

( * ) Notice: Subject to any disclaimer, the term of this patent is extended or adjusted under 35 U.S.C. 154(b) by 685 days.

(21) Appl. No.: 11/194,670

(22) Filed: Aug. 2, 2005

(65) Prior Publication Data

US 2006/0096336 A1 May 11, 2006

(30) Foreign Application Priority Data

Nov. 9, 2004 (JP) ..... 2004-324816

(51) Int. Cl.
*D06F 39/08* (2006.01)

(52) U.S. Cl. ..... 68/208

(58) Field of Classification Search ..... 68/208; 134/186

See application file for complete search history.

(56) References Cited

U.S. PATENT DOCUMENTS

| | | | | | |
|---|---|---|---|---|---|
| 2,201,790 | A | * | 5/1940 | Rouch | 68/208 |
| 2,412,078 | A | * | 12/1946 | Breckenridge et al. | 68/139 |
| 2,443,816 | A | * | 6/1948 | Davis, Jr. | 137/583 |
| 2,807,949 | A | * | 10/1957 | Molnar | 68/18 F |
| 2,919,568 | A | * | 1/1960 | Stone et al. | 68/18 F |
| 2,987,905 | A | * | 6/1961 | Braun | 68/208 |
| 3,285,038 | A | * | 11/1966 | Wolverton | 68/19.2 |
| 3,310,063 | A | * | 3/1967 | Edwards | 137/216 |
| 4,066,094 | A | * | 1/1978 | Stitch | 137/387 |
| 4,125,003 | A | * | 11/1978 | Wasemann | 68/208 |
| 4,821,537 | A | | 4/1989 | Zinkann et al. | |
| 5,868,011 | A | * | 2/1999 | Hawkins et al. | 68/208 |
| 6,568,017 | B2 | * | 5/2003 | Cheo et al. | 8/158 |

FOREIGN PATENT DOCUMENTS

| | | |
|---|---|---|
| JP | 08-276939 | * 10/1996 |
| JP | 09-075586 | 3/1997 |
| JP | 10-201988 | 8/1998 |
| KR | 2000-0043375 | 7/2000 |

OTHER PUBLICATIONS

European Patent Office 0 378 058 Jul. 1990.*

* cited by examiner

*Primary Examiner*—Frankie L Stinson
(74) *Attorney, Agent, or Firm*—Bacon & Thomas, PLLC

(57) ABSTRACT

A drum type washing machine includes a water tub; a cylindrical rotary drum rotatably installed in the water tub such that a central axis of rotation of the rotary drum is horizontal or slanted; a water outlet provided on a bottom portion of the water tub; a motor for rotating the rotary drum; a water supplying unit for supplying wash water into the water tub; a water draining unit for draining the wash water from the water tub; and a controller for controlling the motor, the water supplying unit and the water draining unit to thereby perform a washing, a rinsing and a water-extracting process. A guiding member with a guiding surface is installed on an inner bottom portion of the water tub to facilitate collection of the wash water and guide the collected wash water toward the water outlet during the water-extracting process.

10 Claims, 7 Drawing Sheets

DRUM TYPE WASHING MACHINE

FIELD OF THE INVENTION

The present invention relates to a drum type washing machine for washing laundry loaded in a rotary drum.

BACKGROUND OF THE INVENTION

A conventional drum type washing machine is shown in FIG. 7. Below its configuration is described.

As shown in FIG. 7, drum 1 provided with multiple drum perforations 2 in its cylindrical surface is rotatably installed in water tub 3. One end of rotating shaft 4 is fixed at the center of rotation of drum 1, and its other end is connected to drum pulley 5. Motor 6 is connected to drum pulley 5 via belt 7, so that it can rotate drum 1. An opening of drum 1 is opened or closed by door 8. Water tub 3 is suspended from washing machine main body 9 via springs 10 and supported therein via vibration damper 11 in such a way that vibrations of water tub 3 are not transmitted to washing machine main body 9 during a water-extracting process. Further, water tub 3 is also provided with balancing weight 12 for absorbing the vibrations during the water-extracting process. Through water supply valve 13 wash water enters water tub 3, while through water drain pump 14 the wash water is goes out the tub. Heater 15 heats the wash water in water tub 3. Controller 16 controls operations of motor 6, water supply valve 13, water drain pump 14, heater 15 and so forth, to thereby control a series of operations including washing, rinsing and water-extracting processes in sequence (see, for example, Japanese Patent Laid-open Application No. H10-201988).

Here, the operation of a drum type washing machine with the above configuration will be described.

If a washing operation of the drum type washing machine is started after loading laundry into drum 1 through opening door 8, water supply valve 13 is opened, so that fresh wash water enters water tub 3. When the water level in water tub 3 reaches a predetermined level, water supply valve 13 is closed, and no more water enters the tub. Thereafter, drum 1 is rotated by motor 6 at a low rpm, during which the laundry loaded in drum 1 is lifted up and then plunged into the water over and over again, so as to loosen dirt. After a certain period of the wash cycle, water drain pump 14 is opened to drain soiled wash water from water tub 3, and an intermediate water-extracting operation is performed. Then, a rinse cycle is started, wherein the same operation as described in the washing process is performed. Thereafter, drum 1 is spun at a high rpm during a subsequent water-extracting cycle to wring out the water in the laundry using centrifugal force.

As for the conventional water-extracting process, although the drum is spun at a low rpm or subjected to an intermittent rotation in the initial stage of the water-extracting cycle to wring out wash water from the laundry, it has been impossible to completely eliminate residual water collecting at the bottom portion of the water tub due to various factors such as the water drain-hose layout or different laundry types which can affect the performance of the draining system.

Moreover, as for the draining conditions or factors affecting the drain behavior, they depend significantly on laundry types or operating conditions: the type and amount of detergent in the drum; soil types in the laundry. Because programming a water-extracting process based on such numerous factors is complicated, it is performed assuming the worst conditions for these factors. Consequently, the duration of the low-rpm or intermittent rotations of the drum is usually set to be excessively long, thereby undesirably extending the duration of the water-extracting process even if it may be unnecessary.

Further, if the water-extracting cycle is started while the clothes in the drum are entangled after the wash cycle, the overall weight distribution in the drum can be imbalanced during the water-extracting cycle. If the water-extracting process is performed in an off-balanced state, the drum will vibrate greatly as its rotational number hits the vibration resonance point of the water tub and others. As a result, excessive suds are generated as the wash water in the water tub contacts the drum, thereby causing an operational failure. Further, since the rotational number of the drum cannot be increased above the vibration resonance point, desired rinsing and water-extracting performance cannot be obtained.

SUMMARY OF THE INVENTION

It is, therefore, an object of the present invention to provide a drum type washing machine capable of reducing water-extracting times and obtaining desired rinsing efficiency, while eliminating problems such as operational failure from excessive suds during a water-extracting cycle.

In accordance with a preferred embodiment of the present invention, there is provided a drum type washing machine including: a water tub suspended in the washing machine; a cylindrical rotary drum rotatably installed in the water tub such that a central axis of rotation of the rotary drum is horizontal or slanted with respect to a horizontal direction; a water outlet provided on a bottom portion of the water tub; a motor for rotating the rotary drum; a water supplying unit for supplying wash water into the water tub; a water draining unit for draining the wash water from the water tub; and a controller for controlling operations of the motor, the water supplying unit and the water draining unit to thereby perform a washing, a rinsing and a water-extracting process, wherein a guiding member with a guiding surface is installed on an inner bottom portion of the water tub to facilitate collection of the wash water and guide the collected wash water toward the water outlet during the water-extracting process.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

First Preferred Embodiment

Hereinafter, preferred embodiments of the present invention will be described with reference to the accompanying drawings. Here, it is to be noted that the present invention is not limited thereto.

Figure 1:
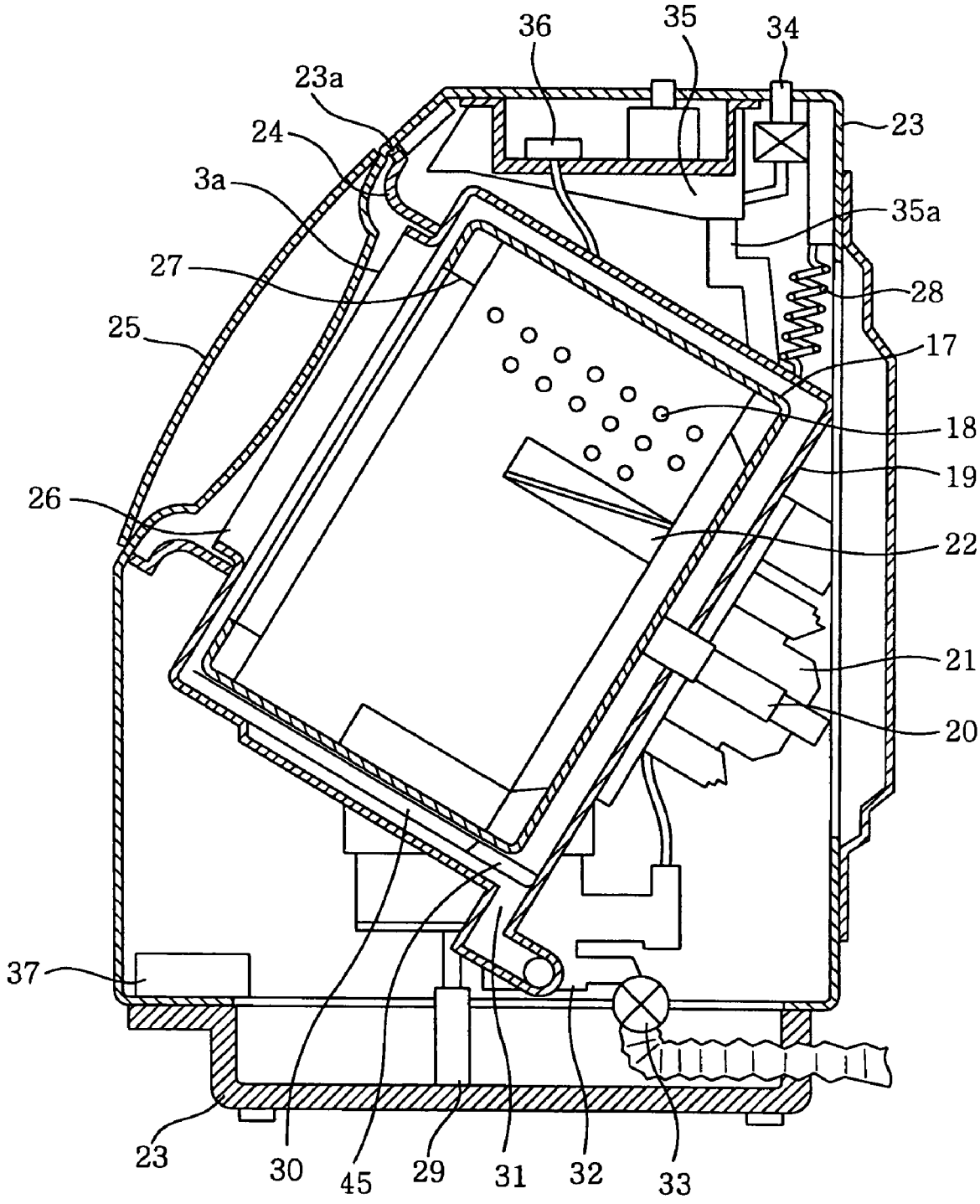
FIG. 1 is a lateral cross sectional view of a drum type washing machine in accordance with a first preferred embodiment of the present invention.

FIG. 1 is a lateral cross sectional view of a drum type washing machine in accordance with a first preferred embodiment of the present invention. As shown in the figure, cylindrical rotary drum 17 having a bottom surface is provided with multiple drum perforations 18 in its cylindrical surface and is rotatably installed in water tub 19. Further, rotary drum 17 is also provided with rotating shaft (central axis of rotation) 20 at its center of rotation and is arranged such that its central axis of rotation is declined from the front side of the drum type washing machine toward the rear side thereof. Further, motor 21 installed at the rear portion of water tub 19 is connected to rotating shaft 20, so that rotary drum 17 is driven by motor 21 to rotate in a clockwise and counterclockwise direction. Further, multiple agitation blades 22 are disposed on the inner cylindrical surface of rotary drum 17.

Opening 24 formed at inclined surface 23*a* of washing machine main body 23 in the front side of water tub 19 is opened and closed by door 25. By opening door 25, laundry can be loaded into or unloaded from rotary drum 17 through opening 24, water tub laundry loading/unloading opening 26 and rotary drum laundry loading/unloading opening 27. Since door 25 is installed at inclined surface 23*a*, loading/unloading of laundry can be done without a user having to bend down considerably.

Water tub 19 is suspended in washing machine main body 23 by spring 28 and damper 29 such that it is allowed to vibrate or shake therein. Recessed drain groove 30 elongated in the direction of rotating shaft 20 is formed in the inner bottom portion of water tub 19, and water outlet 31 is provided in the vicinity of the rear bottom portion of drain groove 30. Connected to water outlet 31 is one end of water drain conduit 32, and the other end of water drain conduit 32 is coupled to water drain valve (water draining unit) 33 to drain wash water from water tub 19. Water supply valve (water supplying unit) 34 supplies wash water into water tub 19 via detergent dispenser 35 and water supply conduit 35*a*. Further, water level detector 36 detects water level in water tub 19.

Figure 2:
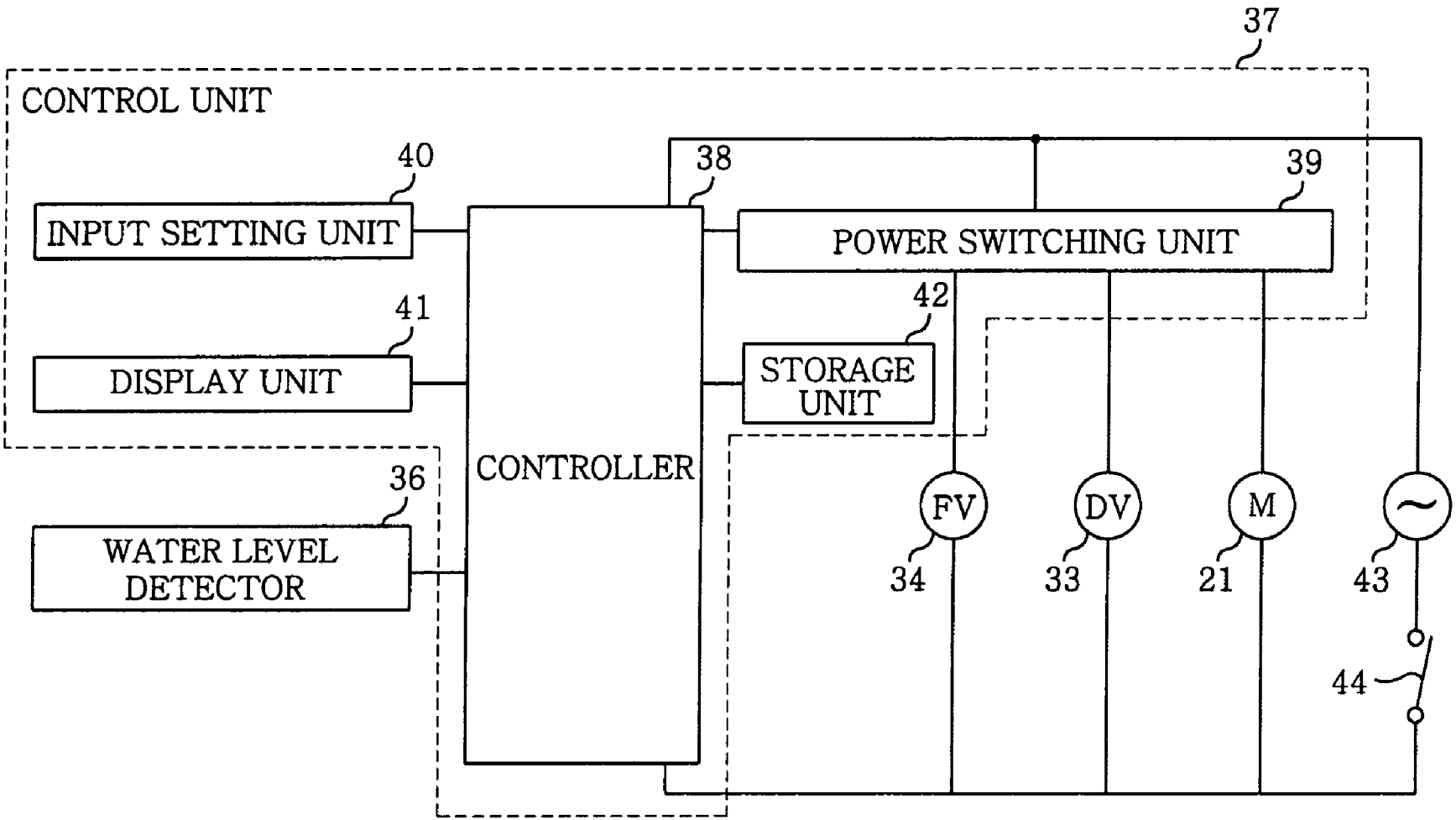
FIG. 2 sets forth a block circuit diagram of the drum type washing machine in accordance with the first embodiment of the present invention.

FIG. 2 illustrates a configuration of control unit 37. As shown in the figure, control unit 37 includes controller 38 with a microcomputer and controls the operations of motor 21, water drain valve (DV) 33, water supply valve (FV) 34, and so forth via power switching unit 39, to thereby control a series of operations including washing, rinsing, and water-extracting processes in sequence.

As for controller 38, it receives an input signal from input setting unit 40 for setting an operational option or the like, while it informs user of the input information through display unit 41. Storage unit 42 stores therein data necessary for controller 38 to perform the control operation. Further, reference numerals 43 and 44 represent a commercial power source and a power switch, respectively.

As shown in FIG. 1, guiding member 45 is installed in drain groove 30 to facilitate the collection of the wash water in drain groove 30 and guide the collected wash water toward water outlet 31.

Figure 3A:
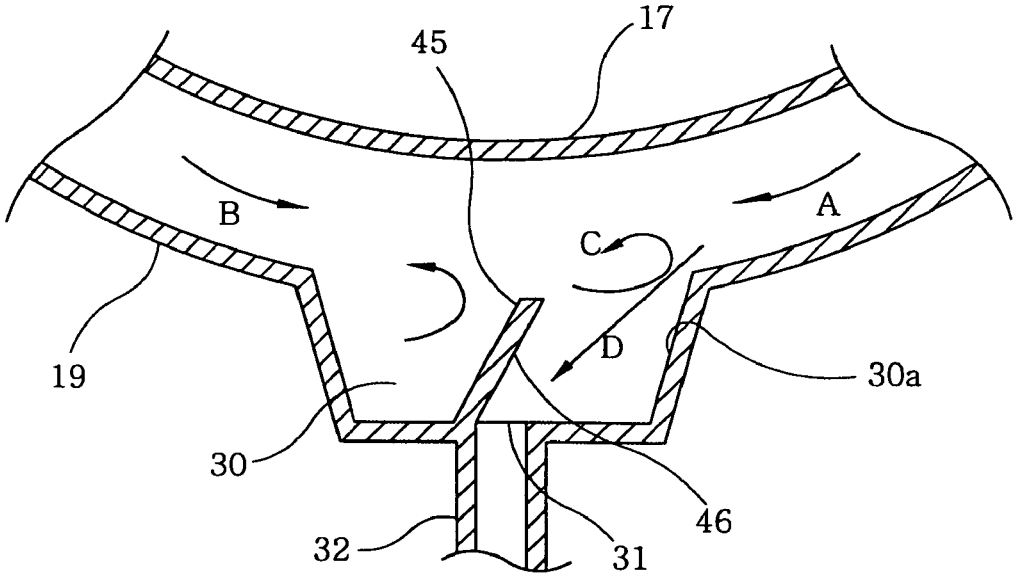
FIGS. 3A and 3B provide a cross sectional view and a perspective view of main components of the drum type washing machine in accordance with the first embodiment of the present invention, respectively.
Figure 3B:
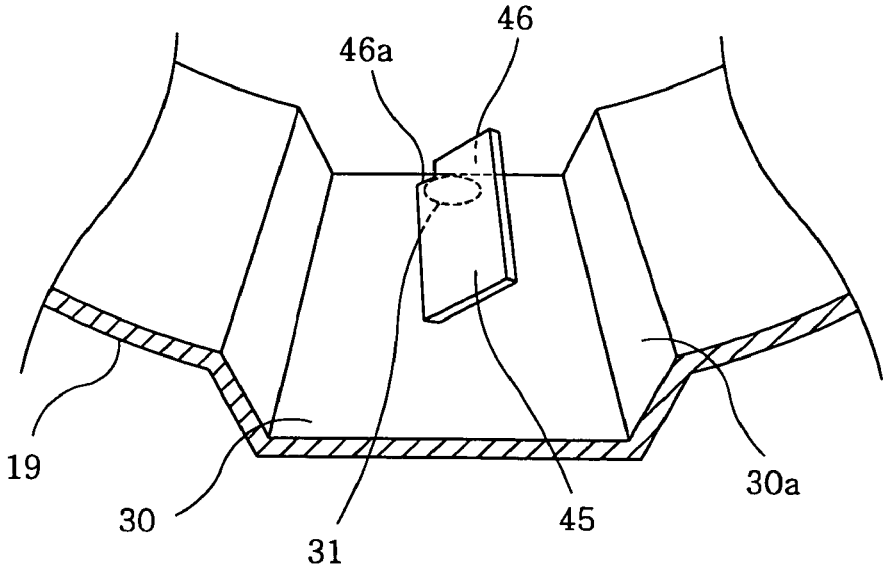

FIG. 3A shows a cross sectional view of a vicinity of water outlet 31 in drain groove 30 while FIG. 3B provides a perspective view thereof. When viewed from the front, the rotational direction of rotary drum 17 during the water-extracting process is clockwise (as indicated by arrow A). Guiding member 45 is installed in the vicinity of water outlet 31 formed in the inner bottom portion of drain groove 30 disposed on the bottom portion of water tub 19. Guiding member 45 is located downstream of the water flow indicated by arrow A (rotational direction of rotary drum 17 during the water-extracting process) with respect to water outlet 31, wherein guiding surface 46 of guiding member 45 is designed such that its top end is leaning towards the upstream side of the water flow indicated by arrow A. Further, guiding surface 46 has cutoff portion 46*a* at its rear lower portion connected to the rear portion of water tub 19. Through the cutoff portion 46*a*, wash water collected in the rear portion of guiding surface 46 of guiding member 45 (downstream of the water flow indicated by arrow A) can also exit through water outlet 31, whereby no residual wash water remains in drain groove 30.

Operation of the washing machine with the above configuration will now be described. If a washing process is initiated after loading laundry into rotary drum 17 through opening door 25 and adding detergent into detergent dispenser 35, water supply valve 34 is operated, so that fresh wash water is supplied in water tub 19 via detergent dispenser 35 and water supply conduit 35*a*, while dissolving detergent therein. Concurrently, rotary drum 17 is driven to rotate at a first rotational speed (for example, 120 r/min). At this time, rotary drum 17 rotates counterclockwise (as indicated by arrow B) when viewed from the front.

As a result of the rotation of rotary drum 17, the wash water containing detergent therein is agitated and the detergent is gradually dissolved in the wash water. Concurrently, the wash water hits sidewall 30*a* of drain groove 30 and the top surface of guiding member 45, as indicated by arrow C. This generates suds with high-concentration detergent components therein, and thus generated suds gradually fill up the space between rotary drum 17 and water tub 19. Then, when the space between rotary drum 17 and water tub 19 is filled with the suds, they rise to the front portions of rotary drum 17 and water tub 19 to enter rotary drum 17 through rotary drum laundry loading/unloading opening 27 and permeate the laundry therein.

Then, by centrifugal force from the rotation of rotary drum 17, the suds loosen soils in the laundry and remove them. Then, the suds leave rotary drum 17 and into the space between rotary drum 17 and water tub 19 through drum perforations 18 provided in the cylindrical surface of rotary drum 17. As this circulation of suds is repeated, laundry is cleaned. After performing this operation for a preset time until water in water tub 19 reaches a predetermined level, the rotational speed of rotary drum 17 is reduced down to a second predetermined rotational speed (for example, 40 r/min), and a washing cycle is performed for a certain time period by repeatedly performing a series of control processes of rotating rotary drum 17 in forward direction, stopping the rotation thereof, rotating rotary drum 17 in reverse direction and stopping the rotation thereof back again.

Further, from the rotation of rotary drum 17 at the second predetermined rotational speed, laundry in rotary drum 17 is lifted up by agitation blades 22 disposed on the inner cylindrical surface of rotary drum 17 and drops down and plunges into the water upon reaching a specific height. As the clothes are thus agitated repeatedly, they undergo pounding motions and are therefore washed.

After a preset time period, the washing process is terminated, and a first water draining process is performed. During the first water draining process, water drain valve 33 is operated, so soiled wash water is drained. The soiled wash water in water tub 19 is discharged out water tub 19 via water outlet 31, water drain conduit 32 and water drain valve 33 in sequence. After the first water draining process, a first water-extracting cycle is performed.

During the first water-extracting cycle, the rotational speed of rotary drum 17 is raised to a third predetermined rotational speed (for example, 900 r/min), and, by spinning rotary drum 17 at the high rotational speed, water in the laundry is extracted therefrom. At this time, the rotational direction of rotary drum 17 is clockwise (as indicated by arrow A) when viewed from the front. Accordingly, the wash water containing the detergent components therein is directed to guiding surface 46 of guiding member 45 after being extracted from the laundry and is directed to water outlet 31, as indicated by arrow D. During the first water-extracting process as described above, wash water collected in the bottom portion of water tub 19 which interferes with the high-speed water-extracting rotation of rotary drum 17 or suds generated between rotary drum 17 and water tub 19 from rotating rotary drum 17 at high rpm can be drained out sufficiently. This enables the rotational speed of rotary drum 17 to be raised to the third predetermined rotational speed smoothly.

After performing the first water-extracting cycle for a preset time period, water supply valve 34 is operated again, so fresh wash water is supplied into water tub 19 via detergent dispenser 35 and water supply conduit 35*a*, and a first rinsing cycle is performed. During the first rinsing cycle, rotary drum 17 is rotated at the second rotational speed (for example, 40 r/min) and a series of control processes of rotating rotary drum 17 in forward direction, stopping the rotation thereof, rotating rotary drum 17 in backward direction and stopping the rotation thereof is performed repeatedly. As a result, the laundry in rotary drum 17 is lifted up by agitation blades 22 disposed on the inner cylindrical surface of rotary drum 17 and then plunges into the water upon reaching a specific height, thereby undergoing agitation motions. This rinsing operation is performed for a predetermined time.

Thereafter, a second water draining process identical to the first water draining process is performed, and then a second water-extracting cycle identical to the first water-extracting cycle is performed. Afterward, a third water draining process identical to the first and the second water draining process is performed and, then, a final water-extracting cycle identical to the first and second water-extracting cycles is executed. Further, the duration of the final water-extracting process is set to be longer than those of the first and second water-extracting cycles.

With regard to the configuration in which rotary drum 17 is slantingly disposed with respect to the horizontal direction as in the first embodiment of the present invention, the wash water extracted from the laundry would be collected in the rear lower portion of water tub 19 through drum perforations 18 of rotary drum 17. At this time, wash water or suds would move up along the sloped surface of water tub 19 due to wind pressure or centrifugal force of rotary drum 17 rotated at high rpm, ultimately causing an incomplete draining of soiled wash water and suds. However, by disposing guiding member 45 with the above configuration in the inner bottom portion of water tub 19, the movement of wash water and suds in the rotational direction of rotary drum 17 during the water-extracting cycle can be blocked by guiding surface 46 of guiding member 45 when the water-extracting cycle is performed. Thus, the wash water and suds are directed into water outlet 31, whereby they smoothly exit through the drain.

Further, it is also preferable to form guiding surface 46 of guiding member 45 concave down, whereby guiding the wash water toward water outlet 31 can be done more smoothly.

By installing guiding member 45 with guiding surface 46 shaped as above, operational failure in the water-extracting cycle due to suds can be avoided, and water can be drained smoothly. Therefore, rinsing and water-extracting cycles can be performed as desired.

Further, although rotary drum 17 is rotated at the first predetermined rotational speed as soon as the supply of water begins in this preferred embodiment, it is also possible to start the rotation of rotary drum 17 after the water level in water tub 19 reaches a predetermined level.

Second Preferred Embodiment

Figure 4A:
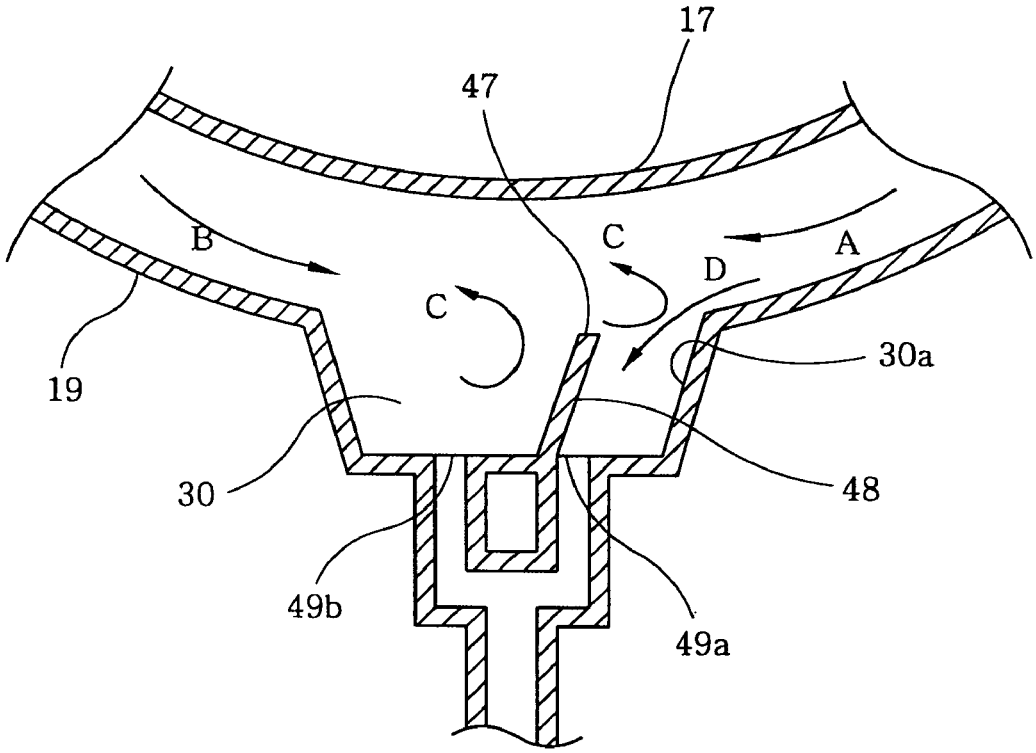
FIGS. 4A and 4B depict a cross sectional view and a perspective view of main components of a drum type washing machine in accordance with a second preferred embodiment of the present invention.
Figure 4B:
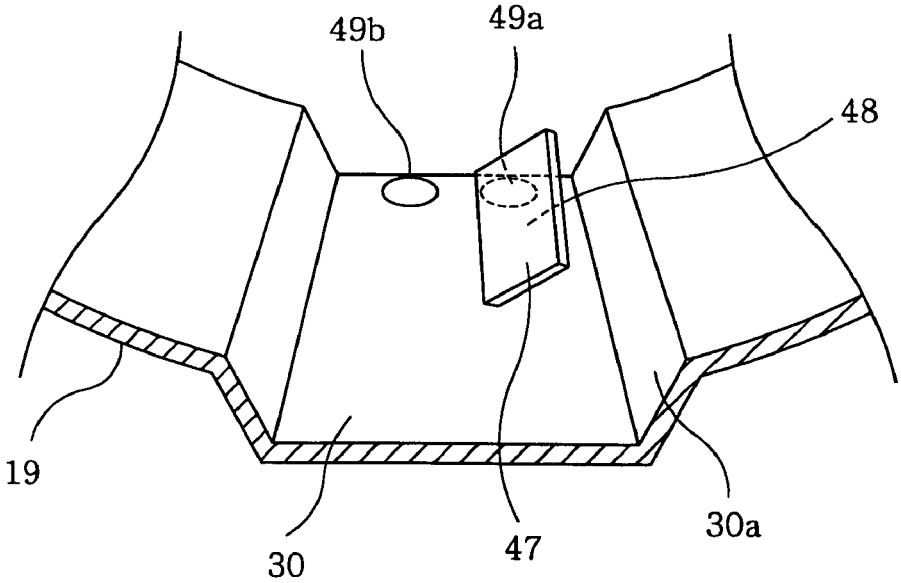

Referring to FIGS. 4A and 4B, there are provided a cross sectional view and a perspective view of the areas around water outlets 49*a* and 49*b* provided in drain groove 30, respectively. Water outlets 49*a* and 49*b* are provided with guiding surface 48 of guiding member 47 disposed therebetween. The rest of the configurations are identical to those described in the first embodiment, so they will not be discussed, while assigning like reference numerals thereto.

In the above configuration, residual wash water collected in the rear side portion (downstream of water flow indicated by arrow A) of guiding surface 48 of guiding member 47 can be completely drained through water outlet 49*b*. Therefore, very little wash water remains in drain groove 30.

Moreover, since the configurations, functions and effects of guiding member 47, guiding surface 48 and water outlet 49*a* in the washing and water-extracting cycles are identical to those of guiding member 45, guiding surface 46 and water outlet 31 in the first embodiment, their discussion will be omitted.

In accordance with the second preferred embodiment of the present invention described above, draining of water can be performed efficiently, while avoiding operational failure during water-extracting cycles due to suds. This is done by directing the suds and wash water toward the water outlets and discharging them through the drain efficiently. As a consequence, rinsing and water-extracting cycles can be performed as desired, and water-extracting times can be shortened.

Third Preferred Embodiment

Figure 5A:
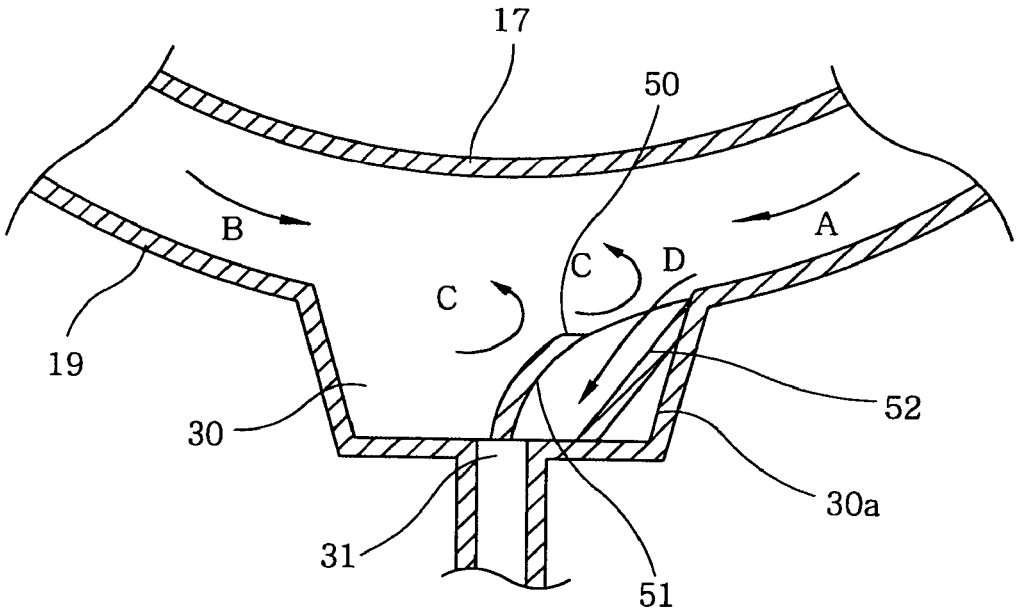
FIGS. 5A and 5B present a cross sectional view and a perspective view of main components of a drum type washing machine in accordance with a third preferred embodiment of the present invention.
Figure 5B:
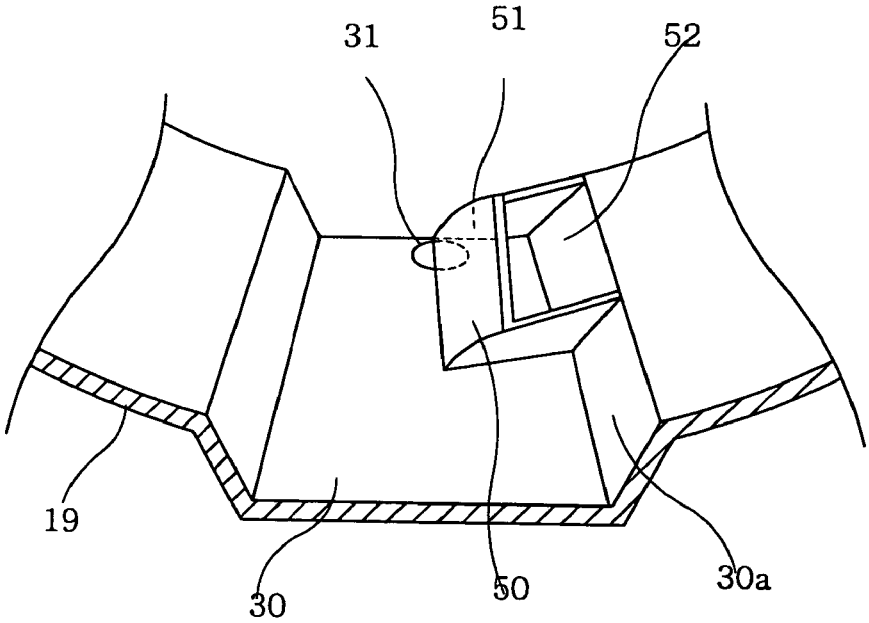

Referring to FIGS. 5A and 5B, there are provided a cross sectional view and a perspective view of the areas around water outlet 31 provided in drain groove 30, respectively. Guiding surface 51 of guiding member 50 is shaped so it concaves down, and a bottom portion of guiding surface 51 of guiding member 50 is disposed such that it divides water outlet 31 into two parts. Further, in order to make the level drop between water tub 19 and drain groove 30 less abrupt, sidewall 30*a* of drain groove 30 is provided with sloped surface 52. Also, guiding member 50 is provided with side walls to connect both ends of guiding surface 51 to sidewall 30*a*. The other configurations are identical to those described in the first embodiment, and their discussion will be omitted, while assigning like reference numerals thereto.

By shaping guiding surface 51 of guiding member 50 to concave down as above, turbulent flow of suds and wash water can be avoided and controlled, so that they can be directed to water outlet 31 smoothly. Moreover, slopped surface 52 provided to form a more gradual level drop between water tub 19 and drain groove 30 also suppresses the turbulent flow of suds and wash water. Overall, this change leads to a better management of wash water and suds to water outlet 31.

Furthermore, by shaping the guiding surface 51, it can better withstand wind pressure or centrifugal force applied from rotary drum 17 which is rotated at high rpm during the water-extracting cycle.

Further, by disposing guiding member 50 such that it splits water outlet 31 into two parts, the wash water collected in the rear side portion (downstream of water flow indicated by arrow A) of guiding surface 51 of guiding member 50 can also be drained through water outlet 31 completely, so that very little wash water remains in drain groove 30. In addition, since the pressure acting on the side of guiding surface 51 that is to force wash water and suds into water outlet 31 incurs only negligible loss, the wash water and suds are quickly drained. The curved surface can be formed of multiple continuous surfaces to have the same effect.

Moreover, since the configurations, functions and effects of guiding member 50, guiding surface 51 and water outlet 31 are identical to those of guiding member 45, guiding surface 46 and water outlet 31 in the first embodiment, their discussion will be omitted.

In accordance with the third preferred embodiment of the present invention described above, while having a configuration enabled to better withstand wind pressure or centrifugal force of wash water, the turbulent flow of suds and wash water can be avoided, thereby preventing the undesirable generation of additional suds. Further, by guiding the suds and wash water toward the water outlet with the above configuration, an operational failure due to suds can be avoided during a water-extracting cycle, and the water-extracting cycle is improved. Overall, this change allows rinsing and water-extracting cycles to be performed as desired and water-extracting times can be reduced.

Fourth Preferred Embodiment

Figure 6A:
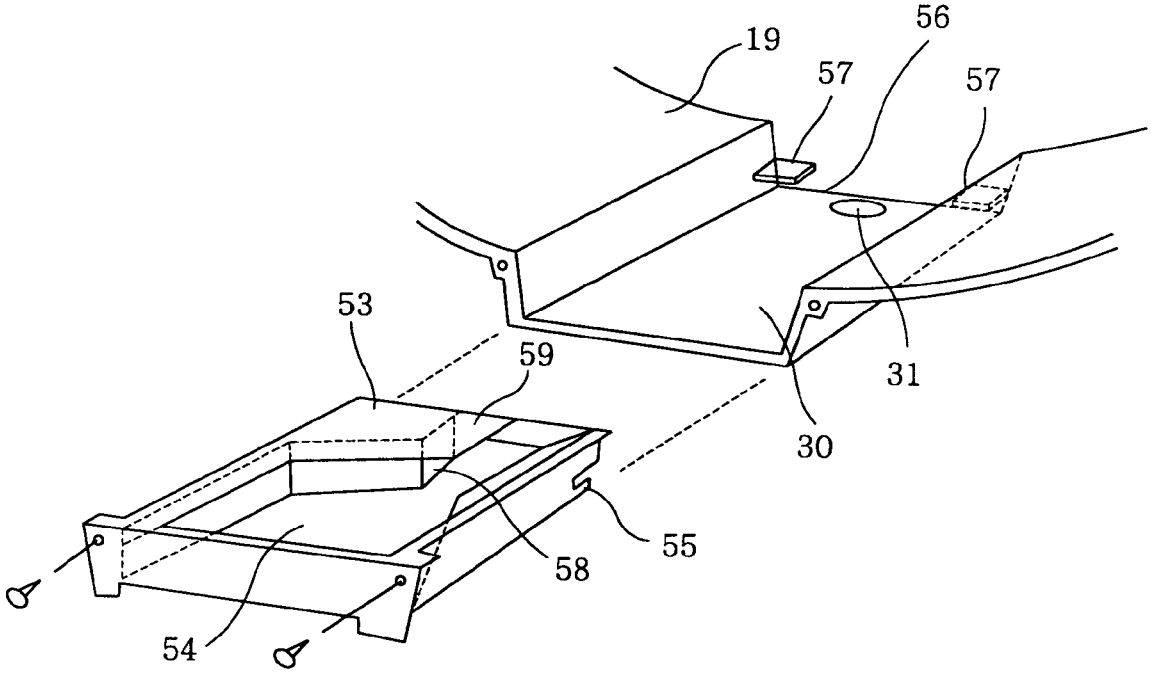
FIGS. 6A and 6B show a perspective view and a cross sectional view of main components of a drum type washing machine in accordance with a fourth preferred embodiment of the present invention.
Figure 6B:
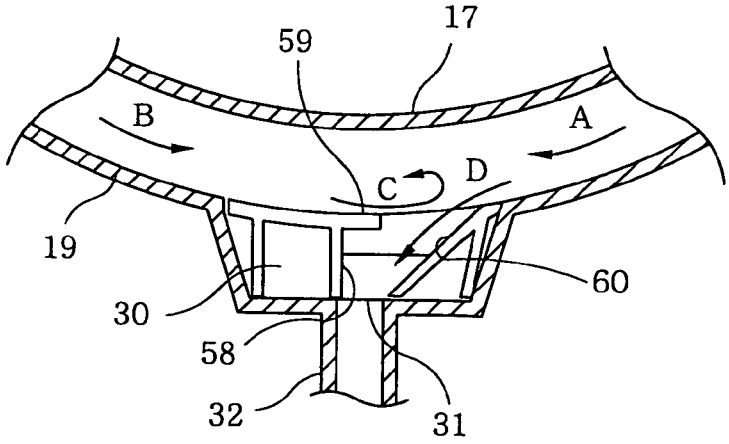
Figure 7:
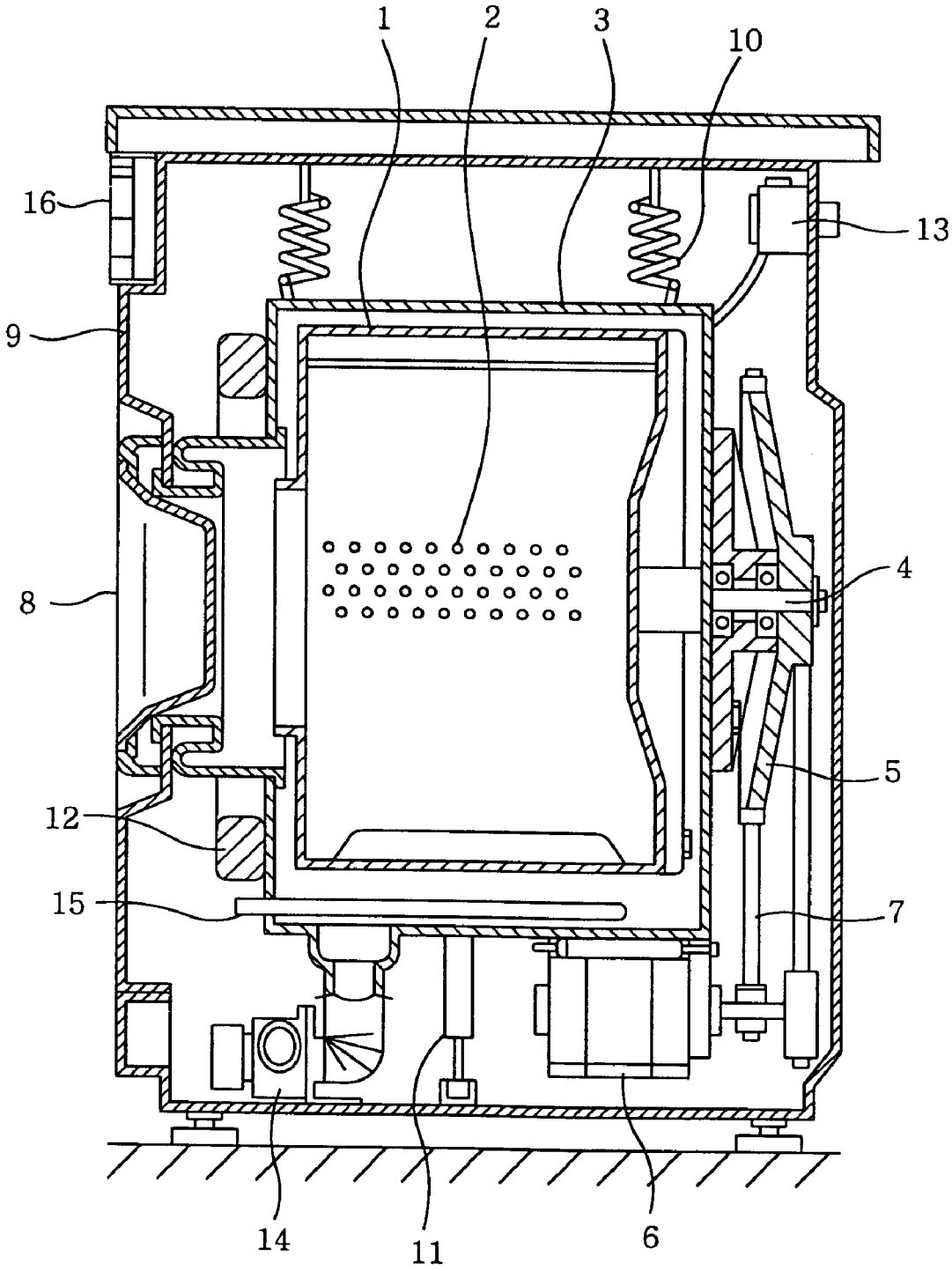
FIG. 7 (PRIOR ART)
FIG. 7 illustrates a lateral cross sectional view of a conventional drum type washing machine.

FIG. 6A is an exploded perspective view illustrating an attachment of guiding member 53 to the vicinity of water outlet 31 provided in drain groove 30, and FIG. 6B provides a cross sectional view illustrating guiding member 53 attached to drain groove 30.

As shown in the figures, guiding member 53 is of an approximately rectangular shape with an opening 54 and is detachably attached to drain groove 30. Guiding member 53 has protrusions 55 protruding backward at its left and right lower portions. Further, engagement portion 57 are formed as one body with the rear lower portion of drain groove 30 to provide recesses 56 therebelow. In order to attach guiding member 53 to drain groove 30, protrusions 55 are inserted into recesses 56 and top surfaces of protrusions 55 are engaged with the bottom surfaces of engagement portion 57. Then, the front portion of guiding member 53 is fixed to the front portion of drain groove 30 by screwing it into screw holes provided at the front portion of drain groove 30. Further, in its opening 54, guiding member 53 has wall portion 58, which is disposed downstream of water flow indicated by arrow A (rotational direction of rotary drum 17 during the water-extracting process) with respect to water outlet 31, and flange portion 59 extended approximately horizontally from the top end portion of wall portion 58. Flange portion 59 is configured to cover at least part of water outlet 31. Moreover, guiding member 53 also has in it opening 54 slopped surface 60 at a position corresponding to wall portion 58 with respect to water outlet 31 located therebetween, wherein slopped surface 60 is formed as one body with guiding member 53 from a top portion of drain groove 30 to the vicinity of water outlet 31. The other configurations of the third embodiment are identical to those described in the first embodiment, and their discussion will be omitted.

As described above, guiding member 53 having the above configuration includes wall portion 58 and flange portion 59 that serve as guiding surfaces and also has slopped surface 60 formed as one body therewith that functions to make the level difference between water tub 19 and drain groove 30 more gradual. This configuration makes attachment of guiding member 53 to water tub 19 more effortless. Further, wall portion 58, flange portion 59, slopped surface 60 and water outlet 31 are better integrated. In addition, this design better directs waste suds and wash water in the drain groove and toward the water outlet by applying thereon pressure in the direction of the water outlet. As a result, waste suds and wash water can be drained efficiently.

Further, in the first to fourth preferred embodiments, although rotary drum 17 having rotating shaft 20 at its center of rotation is installed such that its rotational axis is declined toward the rear portion of the washing machine, rotary drum 17 can also be arranged such that its rotational axis is approximately horizontal.

Further, in the first to the third embodiments, the guiding members can be formed as one body with water tub 19 or formed as separate components as in the fourth preferred embodiment.

As discussed above, the drum type washing machine in accordance with the present invention is capable of directing suds and wash water toward the water outlet effectively even when residual wash water is collected in the inner bottom portion of the water tub and when the space between the water tub and the rotary drum is filled with suds. Therefore, it prevents an operational failure due to suds, and performs an improved water-extracting cycle, thereby performing rinsing and water-extracting cycles as desired. Therefore, the efficiency of the washing machine is improved considerably.

While the invention has been shown and described with respect to the preferred embodiments, it will be understood by those skilled in the art that various changes and modifications may be made without departing from the spirit and scope of the invention as defined in the following claims.

What is claimed is:

1. A drum type washing machine comprising:

a water tub suspended in the washing machine;

a cylindrical rotary drum rotatably installed in the water tub such that a central axis of rotation of The rotary drum is horizontal or slanted with respect to a horizontal direction;

a water outlet provided on a bottom portion of the water tub;

a motor for rotating the rotary drum;

a water supplying unit for supplying wash water into the water tub;

a water draining unit for draining the wash water from the water tub; and a controller for controlling operations of the motor, the water supplying unit and the water draining unit to thereby perform a washing, a rinsing and a water-extracting process, wherein a guiding member with a guiding surface is installed on an inner bottom portion of the water tub to facilitate collection of the wash water and guide the collected wash water toward the water outlet during the water-extracting process, wherein a recessed drain groove elongated in a direction of the central axis of rotation of the rotary drum is provided on the inner bottom portion of the water tub, and a water outlet is provided on a bottom portion of the drain groove, and wherein the guiding member is provided with an opening for allowing the wash water to flow thereinto, and the guiding surface of the guiding member is formed of a wall portion and a flange portion extending from the wall portion substantially in a horizontal direction, the wall portion being located on the downstream side with respect to the water outlet along a rotational direction of the rotary drum during the water-extracting process, and one end of the flange portion forming one side of the opening.

2. The washing machine of claim 1, wherein the guiding member includes a guiding surface having a wall portion installed on the downstream side with respect to the water outlet along the rotational direction of the rotary drum during the water-extracting process and a flange portion extending from a top end portion of the wall portion; and a sloped surface installed on the upstream side with respect to the water outlet along the rotational direction of the rotary drum during the water-extracting process, wherein the wall portion being parallel to a plane perpendicularly intersecting a central axis of the rotary drum, the flange portion covering at least part of the water outlet, and the sloped surface extending from an upper portion of the drain groove to an area near the water outlet, the water outlet being interposed between the wall portion and the sloped portion.

3. The washing machine of claim 2, wherein the guiding surface and the slopped surface of the guiding member are formed as one body, and are attached and fixed in the drain groove.

4. The washing machine of claim 2, wherein, at an initial stage of the washing process, the controller performs a detergent-foam generating process for rotating the rotary drum at a rotational speed that allows laundry loaded in the rotary drum to be stuck on an inner cylindrical surface of the rotary drum, and the rotational direction of the rotary drum during the detergent-foam generating process is opposite to that in the water-extracting process.

5. The washing machine of claim 1, wherein the guiding member is provided with an opening for allowing the wash water to flow thereinto, and is installed in the drain groove by inserting protrusions formed on a rear portion of the guiding member into recesses provided on a rear side of the drain groove and screwing a front portion of the guiding member to a front portion of the drain groove.

6. The washing machine of claim 1, wherein the flange portion covers at least part of the water outlet.

7. A drum type washing machine comprising:

a water tub suspended in the washing machine;

a cylindrical rotary drum rotatably installed in the water tub such that a central axis of rotation of the rotary drum is horizontal or slanted with respect to a horizontal direction;

a water outlet provided on a bottom portion of the water tub;

a motor for rotating the rotary drum;

a water supplying unit for supplying wash water into the water tub;

a water draining unit for draining the wash water from the water tub; and a controller for controlling operations of the motor, the water supplying unit and the water draining unit to thereby perform a washing, a rinsing and a water-extracting process, wherein a guiding member with a guiding surface is installed on an inner bottom portion of the water tub to facilitate collection of the wash water and guide the collected wash water toward the water outlet during the water-extracting process, wherein a recessed drain groove elongated in a direction of the central axis of rotation of the rotary drum is provided on the inner bottom portion of the water tub, and a water outlet is provided on a bottom portion of the drain groove, and wherein the guiding member includes a guiding surface having a wall portion installed on the downstream side with respect to the water outlet along the rotational direction of the rotary drum during the water-extracting process and a flange portion extending from a top end portion of the wall portion; and a sloped surface installed on the upstream side with respect to the water outlet along the rotational direction of the rotary drum during the water-extracting process, wherein the wall portion being parallel to a plane perpendicularly intersecting a central axis of the rotary drum, the flange portion covering at least part of the water outlet, and the sloped surface extending from an upper portion of the drain groove to an area near the water outlet, the water outlet being interposed between the wall portion and the sloped portion.

8. The washing machine of claim 7, wherein the guiding surface and the slopped surface of the guiding member are formed as one body, and are attached and fixed in the drain groove.

9. The washing machine of claim 7, wherein, at an initial stage of the washing process, the controller performs a detergent-foam generating process for rotating the rotary drum at a rotational speed that allows laundry loaded in the rotary drum to be stuck on an inner cylindrical surface of the rotary drum, and the rotational direction of the rotary drum during the detergent-foam generating process is opposite to that in the water-extracting process.

10. A drum type washing machine comprising:

a water tub suspended in the washing machine;

a cylindrical rotary drum rotatably installed in the water tub such that a central axis of rotation of the rotary drum is horizontal or slanted with respect to a horizontal direction;

a water outlet provided on a bottom portion of the water tub;

a motor for rotating the rotary drum;

a water supplying unit for supplying wash water into the water tub;

a water draining unit for draining the wash water from the water tub; and a controller for controlling operations of the motor, the water supplying unit and the water draining unit to thereby perform a washing, a rinsing and a water-extracting process, wherein a guiding member with a guiding surface is installed on an inner bottom portion of the water tub to facilitate collection of the wash water and guide the collected wash water toward the water outlet during the water-extracting process, wherein a recessed drain groove elongated in a direction of the central axis of rotation of the rotary drum is provided on the inner bottom portion of the water tub, and a water outlet is provided on a bottom portion of the drain groove, and wherein the guiding member is provided with an opening for allowing the wash water to flow thereinto, and is installed in the drain groove by inserting protrusions formed on a rear portion of the guiding member into recesses provided on a rear side of the drain groove and screwing a front portion of the guiding member to a front portion of the drain groove.

* * * * *

UNITED STATES PATENT AND TRADEMARK OFFICE

CERTIFICATE OF CORRECTION

PATENT NO. : 7,607,327 B2
APPLICATION NO. : 11/194670
DATED : October 27, 2009
INVENTOR(S) : Sumida et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1088 days.

Signed and Sealed this

Twelfth Day of October, 2010

David J. Kappos

David J. Kappos
*Director of the United States Patent and Trademark Office*